US005576614A

United States Patent [19]

Meads et al.

[11] Patent Number: 5,576,614

[45] Date of Patent: Nov. 19, 1996

[54] CIRCUIT FOR SUPPLYING CONSTANT VOLTAGE TO A LAMP FROM AN AC INPUT

[75] Inventors: David J. Meads, Hitchin; Keith L. Bedford, Letchworth; Robert Kennedy, Portsmouth; Clive R. Harris, Hitchin, all of United Kingdom

[73] Assignee: Xerox Corporation, Stamford, Conn.

[21] Appl. No.: 250,083

[22] Filed: May 27, 1994

[51] Int. Cl.[6] ..... G05F 1/40

[52] U.S. Cl. ..... 323/239; 323/235; 323/324

[58] Field of Search ..... 323/237, 235, 323/239, 319, 320, 324; 315/DIG. 4, DIG. 5, DIG. 7

[56] References Cited

U.S. PATENT DOCUMENTS

| | | | |
|---|---|---|---|
| 4,423,478 | 12/1983 | Bullock et al. | 363/89 |
| 4,567,425 | 1/1986 | Bloomer | 323/237 |
| 4,578,632 | 3/1986 | Laughton | 323/237 |
| 4,728,866 | 3/1988 | Capewell et al. | 315/224 |
| 4,839,566 | 6/1989 | Herold et al. | 31/308 |
| 5,066,896 | 11/1991 | Bertenshaw et al. | 315/291 |
| 5,159,245 | 10/1992 | Nilssen | 315/206 |
| 5,237,244 | 8/1993 | Bertenshaw et al. | 315/291 |
| 5,365,157 | 11/1994 | Geller et al. | 323/237 |

*Primary Examiner*—Peter S. Wong
*Assistant Examiner*—Y. J. Han

[57] ABSTRACT

A circuit is provided for obtaining precise lamp voltage control and for compensating for varying or fluctuating input from an AC voltage source. The lamp is switched on by a switching device such as a triac. When the triac is powered, a simultaneous powering occurs of a second switching device such as an SCR. The SCR produces a scaled down RMS voltage output which closely matches the actual RMS lamp voltage. This second simulated voltage is precisely controlled in a feedback circuit which includes an RMS to DC converter and a feedback controller. The controller compares a converted DC voltage with a reference voltage and generates a firing pulse to the triac which is advanced or delayed so as to compensate for variations in the AC source as manifested by variations in the converted DC signal relative to the reference signal. Evaluation of the simulated voltage provides the mechanism for precise setting of the converted voltage as a trigger pulse which is generated at the time of the pulse generated by the zero crossing of the AC input.

4 Claims, 2 Drawing Sheets

CIRCUIT FOR SUPPLYING CONSTANT VOLTAGE TO A LAMP FROM AN AC INPUT

BACKGROUND AND MATERIAL DISCLOSURE STATEMENT

The present invention relates to a circuit for supplying power to an exposure lamp and, more particularly, to a AC circuit which maintains a constant lamp voltage irrespective of variations in the AC voltage supply.

Exposure lamps for purposes such as illuminating documents to be copied in a copier must be constructed so that any intensity variations are held to approximately a ±1%. One source of variation in lamp output which may exceed this tolerance are fluctuations and variations in the main ac supply line. In a perfect system, the main voltage wave form is a perfect sine wave having a peak amplitude equal to the √2 times the RMS voltage. However, in practice, the amplitude may be less due to voltage drops in the supply cable, and the sine wave form may be distorted in two main ways. Firstly, the peaks of the wave may be suppressed due to saturation of transformers used in the supply network. Secondly, at a site where thyristor or triac controlled loads are in use, the form of each half wave may be reduced in a final portion of the half wave due to the increased load on the supply compared with the initial portion of the half wave. In other words, when an exposure lamp is driven by a phase controlled electronic switch such as a triac direct from an input AC source, then the shape of the AC waveform directly affects the lamp intensity.

Various techniques are known in the art to compensate for lamp intensity variations. In one technique, the output of the lamp is coupled to, and measured by, a photosensor. The photosensor output is sent via a feedback loop, to control the power output of the lamp. In a second method a smaller lamp is connected in parallel across a main lamp and the light output of the second lamp is monitored and used to control the lamp via feedback loop. A third, more commonly used procedure is to measure the voltage across the lamp using a dedicated isolation transformer with the transformer secondary connected into a feedback control system which alters the firing phase angle of the switch controlling power to the lamp. The present invention improves over the prior art by providing precise lamp illumination control of less than ±1% variation without the necessity for using relatively expensive photosensors or dedicated transformers. This is accomplished by circuitry which simulates the operation and the characteristics of the lamp to produce a voltage output which very closely matches the lamp voltage. This simulated voltage is fed back to a triac switch via a RMS to DC converter. A feedback controller is used to control the firing phase of the triac. More particularly, the invention relates to a circuit for supplying constant RMS voltage to a lamp from an AC voltage supply comprising a first switching element for applying a voltage V1 across a lamp upon application of power from the AC supply, sampling means synchronized with application of said AC voltage to said first switching element for generating an instantaneous RMS voltage V2 modeled to conform to said voltage V1, conversion means for converting said RMS voltage V2 into a DC voltage, and feedback controller means for comparing said converted DC voltage with a reference voltage representing an optimum lamp intensity output and for generating and applying a firing pulse to said switching element thereby controlling the phase angle of said switching element.

DESCRIPTION OF THE INVENTION

Figure 1:
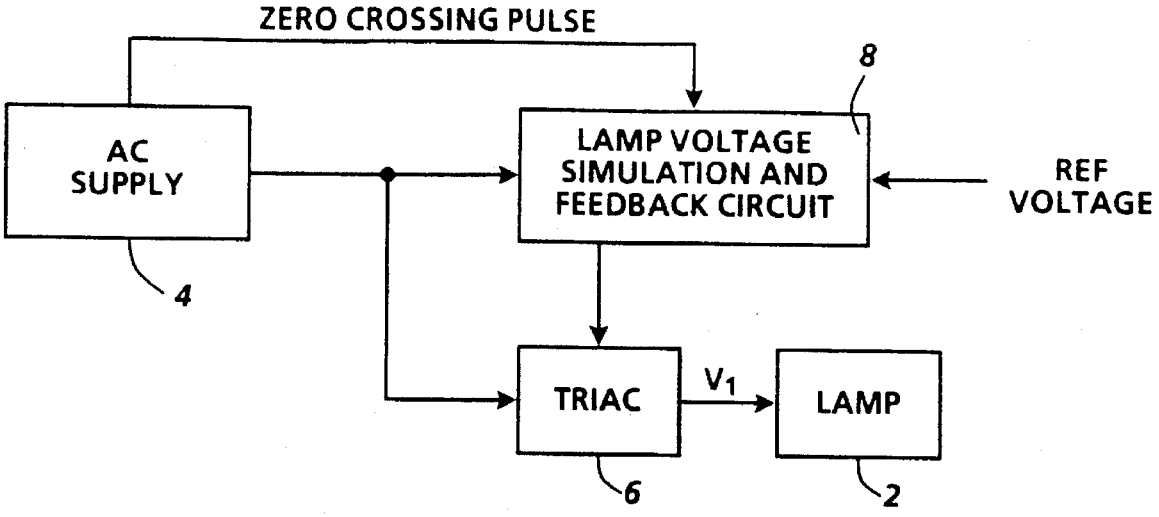
FIG. 1 block diagram of circuitry for supplying a constant lamp voltage from an AC source.

Referring to FIG. 1, a block diagram of the critical circuit components comprising the invention are shown. A lamp 2, which in an exemplary embodiment is a tungsten filament lamp, is powered by an AC voltage supply 4 via a switching element which, in a preferred embodiment, is a triac 6. The triac provides a constant RMS voltage V1 to the lamp. AC supply to the lamp is also applied to a lamp voltage simulation and feedback circuit 8. Circuit 8 performs the function of sampling the lamp supply voltage to generate a second RMS voltage V2 (FIG. 2) which very closely matches the characteristics of lamp voltage V1. A feedback controller within circuit 8 converts the RMS voltage V2 to a DC voltage which is compared with a dc reference voltage level to detect variations in the AC input. The controller generates a firing pulse and applys it to triac 6 at the appropriate phase angle to compensate the lamp voltage for the detected AC variations.

Figure 2:
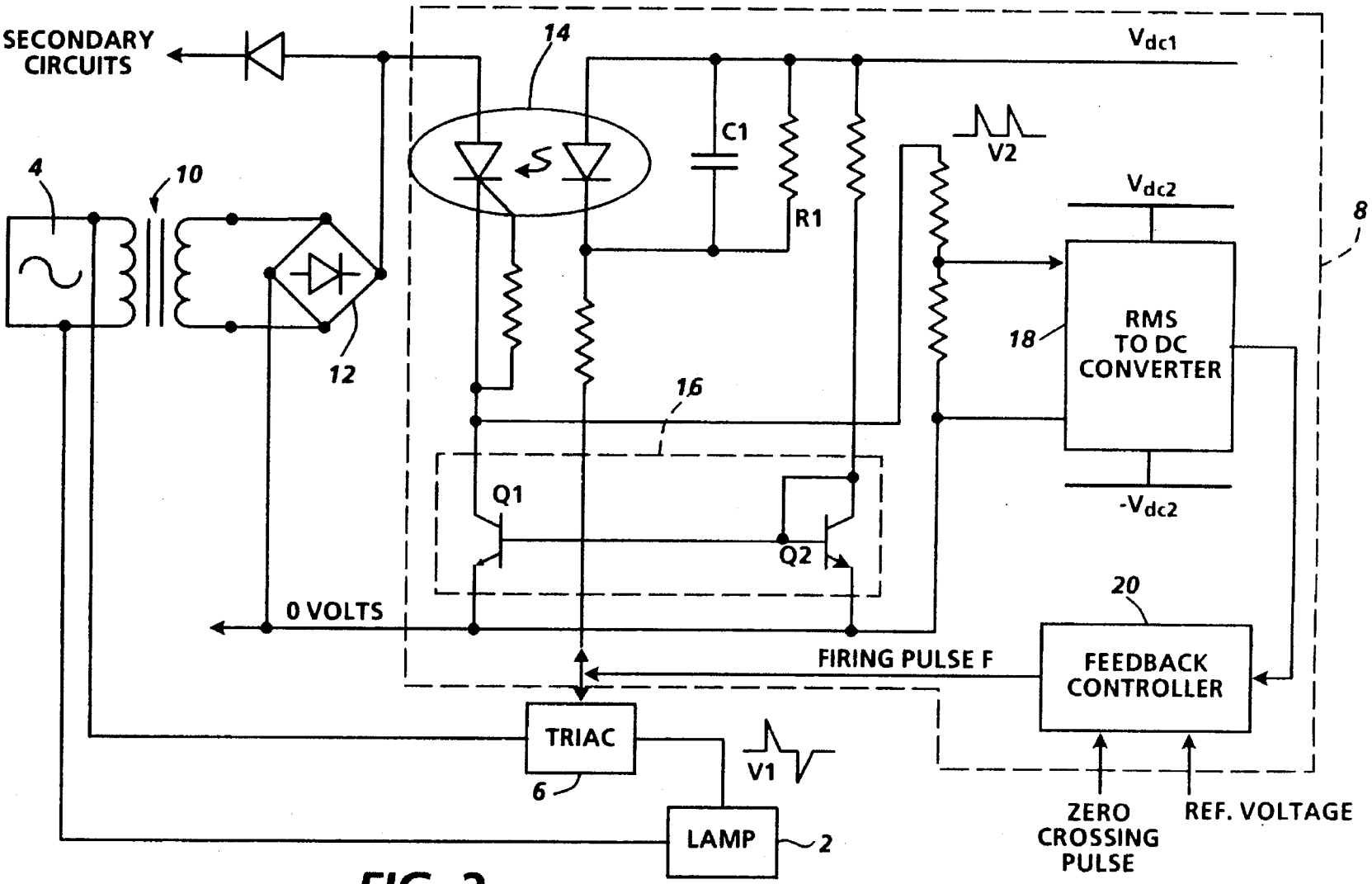
FIG. 2 is a detailed diagram of elements comprising the block diagram of FIG. 1.

Referring now to FIG. 2, there is shown a preferred detailed circuit for the block diagram of FIG. 1. The AC voltage supply output is stepped down by transformer 10 whose output is rectified by full bridge rectifier 12. Lamp simulation and feedback circuit 8 consists of SCR 14, current mirror transistor pair 16, RMS to DC converter 18 and feedback controller 20. In operation, SCR 14 and triac 6 are switched at the same time in the mains cycle by firing pulse F applied to the gate electrode of the triac. When triac 6 is turned on, line voltage V1 is supplied directly across the lamp. When SCR 14 is switched on transistors Q1 and Q2 form a current mirror pair 16 to insure that SCR 14 is held in conduction near the zero crossing of the AC supply. The output voltage V2 of the current mirror pair 16 thus has exactly the same characteristics as V1. V2 is converted from an RMS to a DC voltage in the feedback system comprising RMS to DC converter 18 and feedback controller 20. Converter 18 evaluates the equivalent RMS value of V2 and provides a DC output which is sent to controller 20. Controller 20 compares the DC level of the converted voltage with a reference voltage representing an optimum intensity level of the lamp. The output of controller 20 (firing pulse F) is advanced or delayed with respect to a zero crossing pulse to adjust the phase angle of triac 6 so as to compensate for intensity variations of the AC input as manifested by changes in the converted DC signal. Resistor R1 and capacitor C1 provide a small time delay to match the firing characteristic of the triac precisely Transformer 10 can also be used for other purposes such as to produce zero crossing pulses, provide power to other system, power supplys, etc. It is understood that this additional usage is consistent with the transformer output being an accurate representation of the input. Voltages Vdc1, Vdc2 are stabilized power supplies suitably filtered for the requirements of the circuit.

Since the lamp current and the lamp voltage by means of simulated voltage V2 are detected during each cycle of the AC supply and are used to control the firing phase angle of the triac, fast and accurate control is enabled. Controller 20 will recognize variations in the AC supply and will delay firing pulses to smooth out the intensity variations.

While the invention has been described with reference to the structure disclosed, it will be appreciated that numerous changes and modifications are likely to occur to those skilled in the art, and it is intended to cover all changes and modifications which fall within the true spirit and scope of the invention.

What is claimed is:

1. A circuit for supplying constant RMS voltage to a lamp from an AC voltage supply comprising:

a first switching element for applying a voltage V1 across a lamp upon application of power from the AC supply, sampling means synchronized with application of said AC voltage to said first switching element for generating an instantaneous RMS voltage V2 modeled to conform to said voltage V1, conversion means for converting said RMS voltage V2 into a DC voltage, and feedback controller means for comparing said converted DC voltage with a reference voltage representing an optimum lamp intensity output and for generating and applying a firing pulse to said switching element thereby controlling the phase angle firing of said switching element.

2. The circuit of claim 1 wherein said switching element is a triac having its gate electrode controlled by said firing pulse.

3. A lamp power control system, comprising:

an AC voltage supply;

a lamp;

a switching element interconnecting said voltage supply and said lamp so as to provide a first voltage having a first RMS value to said lamp;

a circuit for generating a second voltage having a second RMS value that is a fraction of said first RMS value;

a converter for converting said second voltage into a DC voltage;

a comparator for comparing said DC voltage to a reference voltage that is representative of a desired first RMS value, said comparator for producing a firing pulse based upon said comparison;

a circuit for controlling said switching element based upon said firing pulse such that said first RMS value is substantially equal to said desired first RMS value.

4. The lamp power control system according to claim 3, wherein said switching element is a triac.

* * * * *